US006276273B1

(12) United States Patent
Aurenty et al.

(10) Patent No.: US 6,276,273 B1
(45) Date of Patent: Aug. 21, 2001

(54) SURFACTANT-PRETREATED PRINTING PLATE SUBSTRATE, LITHOGRAPHIC PRINTING PLATE AND METHOD FOR PRODUCTION THEREOF

(75) Inventors: Patrice M. Aurenty, Wood-Ridge; Roshanak Debeaud, Cranford; Edward Stone, Morris Plains; Gordon Kotora, Clifton, all of NJ (US)

(73) Assignee: Kodak Polychrome Graphics LLC, Norwalk, CT (US)

( * ) Notice: Subject to any disclaimer, the term of this patent is extended or adjusted under 35 U.S.C. 154(b) by 0 days.

(21) Appl. No.: 09/330,072

(22) Filed: Jun. 11, 1999

(51) Int. Cl.[7] ..... B41N 3/03; B41N 3/08

(52) U.S. Cl. ..... 101/457; 101/465; 101/466; 347/106

(58) Field of Search ..... 101/457, 458, 101/459, 463.1, 465, 466, 462; 347/95, 96, 100, 101, 102, 105, 106

(56) References Cited

U.S. PATENT DOCUMENTS

| | | | | |
|---|---|---|---|---|
| 3,511,661 | * | 5/1970 | Rauner et al. | 101/459 |
| 3,877,372 | | 4/1975 | Leeds | 101/465 |
| 4,153,461 | * | 5/1979 | Berghauser et al. | 101/459 |
| 4,272,604 | * | 6/1981 | Meador et al. | 101/459 |
| 4,278,467 | | 7/1981 | Fadner | 106/2 |
| 4,781,985 | | 11/1988 | Desjarlais | 428/421 |
| 4,833,486 | | 5/1989 | Zerillo | 346/1.1 |
| 4,854,969 | | 8/1989 | Bassemir et al. | 106/2 |
| 5,084,340 | | 1/1992 | Light | 428/327 |
| 5,312,654 | * | 5/1994 | Arimatsu et al. | 347/101 |
| 5,364,702 | | 11/1994 | Idei et al. | 428/423.1 |
| 5,368,974 | | 11/1994 | Walls et al. | 430/156 |
| 5,716,436 | | 2/1998 | Sorriero et al. | 106/31.87 |
| 5,820,932 | | 10/1998 | Hallman et al. | 427/261 |
| 5,900,345 | | 5/1999 | Platzer et al. | 430/156 |

FOREIGN PATENT DOCUMENTS

| | | |
|---|---|---|
| 2107980 | 4/1994 | (CA) . |
| 071345 | 6/1985 | (EP) . |
| 0503621 | 9/1992 | (EP) . |
| 0738608 | 10/1996 | (EP) . |
| 0742109 | 11/1996 | (EP) . |
| 751194 | 1/1997 | (EP) . |
| 847868 | 6/1998 | (EP) . |
| 62-059046 | 9/1988 | (JP) . |
| 08329147 | 11/1996 | (JP) . |
| 929926 | 2/1997 | (JP) . |
| 9255765 | 9/1997 | (JP) . |
| 0046036 | 8/2000 | (WO) . |

OTHER PUBLICATIONS

E.I. Dupont de Nemours "Zonyl Surfactants" Production Information Bulletin.

Wicks et al., Organic Coatings: Science and Technology vol. II: Applications, Properties, p. 157 (1994).

* cited by examiner

*Primary Examiner*—Stephen R. Funk
(74) *Attorney, Agent, or Firm*—Baker Botts L.L.P.

(57) ABSTRACT

A printing plate precursor for direct receipt of an image-wise applied ink receptive layer the precursor having a desorbable surfactant adsorbed on at least one surface in an amount effective to improve the resolution of the subsequently image-wise applied ink receptive layer. The printing plate precursor can be used to prepare a printing plate having improved resolution. The printing plate may be prepared by (a) applying a desorbable surfactant to at least one surface of a printing plate substrate, (b) removing non-adsorbed surfactant from the surface, (c) applying a fluid composition containing an ink receptive material onto at least a portion of the surface in the form of a desired image, thereby providing an ink receptive image layer; and (d) removing the desorbable surfactant from any area of the surface which does not form part of the desired image.

33 Claims, 2 Drawing Sheets

SURFACTANT-PRETREATED PRINTING PLATE SUBSTRATE, LITHOGRAPHIC PRINTING PLATE AND METHOD FOR PRODUCTION THEREOF

FIELD OF THE INVENTION

The present invention relates to a printing plate precursor, a lithographic printing plate and an ink jet printing method for production thereof. The lithographic printing plate exhibits improved resolution.

BACKGROUND OF THE INVENTION

The offset lithographic printing process utilizes a developed planographic printing plate having oleophilic image areas and hydrophilic non-image areas. The plate is commonly dampened before or during inking with an oil-based ink composition. The damping process utilizes an aqueous fountain solution such as those described in U.S. Pat. Nos. 3,877,372, 4,278,467 and 4,854,969. When water is applied to the plate, the water will form a film on the hydrophilic areas (i.e. the non-image areas of the plate) but will contract into tiny droplets on the oleophilic plate areas (i.e. the image areas). When a roller carrying an oil-based ink composition is passed over the dampened plate, it will be unable to ink the areas covered by the aqueous film (the non-image areas), but will emulsify the water droplets on the water repellant areas (the image areas) which will then take up ink. The resulting ink image is transferred ("offset") onto a rubber blanket, which is then used to print a substrate such as paper.

It has been proposed to apply "direct" ink jet printing techniques to lithographic printing. For example, European Patent Publication No. 503,621 discloses a direct lithographic plate making method which includes jetting a photocuring ink onto the plate substrate, and exposing the plate to UV radiation to harden the image area. An oil-based ink may then be transferred to the image area for printing onto a printing medium. However, there is no disclosure of the resolution of ink drops jetted onto the substrate, or the durability of the lithographic printing plate with respect to printing runlength.

It is known to improve the resolution of ink jet printers by applying an ink receiving layer to substrates such as metal, plastic, rubber, fabrics, leather, glass and ceramics, prior to printing thereon. See, for example, European Patent Publication No. 738,608 which discloses a thermally curable ink receiving layer containing a first water soluble high molecular weight compound having a cationic site in the main polymer chain and a second water soluble high molecular compound having a side chain containing a condensable functional site. Alternatively, the second high molecular weight compound may be replaced with a monomer or oligomer having at least two (meth)acryloyl sites, which results in a UV radiation curable ink receiving layer.

The addition of fluorosurfactants to an ink receiving layer in order to enhance its surface smoothness, image quality or coating characteristics is known. Thus, U.S. Pat. No. 5,084,340 discloses a transparent ink jet receiving element having an ink receptive layer that contains a fluorosurfactant in order to provide enhanced surface smoothness and to facilitate coating of the ink receiving layer onto the support. European Patent Publication No. 742,109 describes a recording sheet containing a binder, and a mixture of an anionic and a cationic fluorosurfactant which is said to increase dot size and improve image quality.

U.S. Pat. No. 4,781,985 discloses an ink jet transparency which comprises a substantially transparent support and a substantially clear coating thereon which includes a specific fluorosurfactant to prevent trailing of the ink jet ink. The coating thickness is 2–15 microns. The fluorosurfactant is said to result in much larger dot sizes and an improved apparent projected density.

Application of a continuous surfactant layer to a conventional lithographic printing plate substrate for use in conjunction with a photosensitive overcoat is also known. U.S. Pat. No. 5,900,345 discloses a lithographic printing plate having a radiation sensitive coating. A hydrophilizing layer between the substrate and the radiation sensitive coating may additionally contain a surfactant to improve the surface smoothness of the subsequently applied radiation sensitive coating. Alternatively, a separate surfactant layer may be coated on the hydrophilizing layer.

An object of the present invention is to provide a printing plate precursor which can be used to prepare a lithographic printing plate having improved resolution.

A feature of the present invention is a printing plate substrate on which a surfactant is adsorbed prior to being imaged with an ink receptive composition.

Another feature of the invention is the removal of surfactant from non-image areas of the imaged printing plate prior to use of the printing plate on the printing press.

An advantage of the present invention is improved resolution of an ink receptive composition when it is applied by an ink jet printing apparatus without unacceptable reduction of adhesion of the ink receptive layer to the printing plate precursor.

SUMMARY OF THE INVENTION

In one aspect, the present invention relates to a printing plate precursor for direct receipt of an image-wise applied ink receptive layer, comprising a desorbable surfactant adsorbed on at least one surface of a printing plate substrate, the desorbable surfactant being present in an amount effective to improve the resolution of the subsequently applied image-wise ink receptive layer.

In another aspect, the present invention relates to a method for preparing a printing plate precursor, comprising:

(a) applying a desorbable surfactant to at least one surface of a printing plate substrate; and (b) removing non-adsorbed surfactant from said surface.

In still another aspect, the present invention relates to a method for preparing a printing plate, comprising:

(a) applying a desorbable surfactant to at least one surface of a printing plate substrate;

(b) removing non-adsorbed surfactant from said surface;

(c) applying a fluid composition containing an ink receptive material onto at least a portion of said surface in the form of a desired image, thereby providing an ink receptive image layer; and (d) removing said desorbable surfactant from any area of the surface which does not form part of the desired image.

In yet another aspect, the present invention relates to a printing plate prepared from a printing plate precursor.

DETAILED DESCRIPTION OF THE PREFERRED EMBODIMENTS

Figure 1:
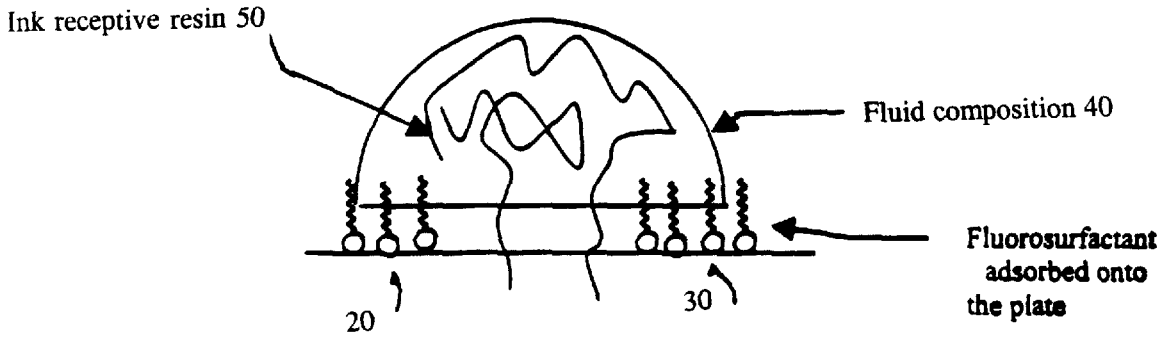
FIG. 1 depicts an idealized surface of a printing plate of the present invention pretreated with a desorbable surfactant and subsequently imaged with a fluid composition containing an ink receptive resin.

"Printing plate substrate" means a non-surfactant treated printing plate substrate. Any conventional printing plate substrate, such as aluminum, polymeric film and paper, may be used as the printing plate substrate of this invention. Roughened aluminum is preferred.

The printing plate substrate may be subjected to known treatments, such as electrograining, anodization, and silication, to enhance its surface characteristics. The printing plate surface may carry a plurality of basic sites, such as sodium silicate groups. Alternatively, the printing plate substrate surface may carry a plurality of acidic sites, such as sulfuric acid groups, phosphonic acid groups and acrylic acid groups, or the surface may be amphoteric.

The inventors have unexpectedly discovered that adsorbing a surfactant to a conventional printing plate substrate, prior to application of an ink receptive layer, can improve the printing plate's resolution. Such a surfactant-treated substrate will be termed a "printing plate precursor" herein.

By "adsorb" it is meant that there is a physico-chemical bond between the surfactant and the substrate surface. A surfactant which is applied to a substrate may or may not physico-chemically bond to the substrate. Surfactant adsorption can be empirically determined by (1) applying the surfactant to the substrate surface, (2) rinsing the surfactant-treated surface under essentially neutral (pH=6 to 7.5) running water for at least thirty seconds, preferably at least one minute, and (3) determining whether the surfactant-treated substrate displays improved resolution relative to the untreated substrate with respect to a subsequently-applied ink receptive composition. Resolution is determined by an ink drop test discussed below.

A particular surfactant is suitable for use in the present invention if it is "desorbable," which means that the surfactant will not only readily adsorb onto the substrate surface, but can also be readily removed from the non-image areas of the substrate after imaging the plate with an ink receptive composition.

The desorbable surfactant will comprise a hydrophobic chain and a hydrophilic moiety. The hydrophobic chain can be straight or branched. Illustrative hydrophobic chains include saturated or unsaturated alkyl groups, saturated or unsaturated alkylaryl groups, fluoro or perfluoro groups and polysiloxane groups.

The hydrophilic moiety can be anionic, cationic, amphoteric or non-ionic. Illustrative hydrophilic groups include sulfonate, sulfate, carboxylate, phosphate, amines and their salts, diamines and their salts, polyamines and their salts, quaternary amine salts, polyoxyethylenated amines, quaternized polyoxyethylenated amines, amine oxides, betaines, sulfobetaines, polyoxyethylene, polyoxyethylene alkylphenol, polyoxyethylene mercaptans carboxylic acid esters, sucrose, polypeptide, polyglycidyl, alkanolamine, alkanolamide, and tertiaryacetylenic glycol.

One of ordinary skill in the art can readily determine whether a particular surfactant is desorbable by simple empirical tests—if the surfactant does not desorb, the non-image areas of the resulting plate will never recover their hydrophilic properties.

Desorbable surfactants include alkyl tail surfactants, fluorosurfactants and siliconated surfactants. Illustrative examples of alkyl tail surfactants include sodium dodecylsulfate, isopropylamine salts of an alkylarylsulfonate, sodium dioctyl succinate, sodium methyl cocoyl taurate, dodecylbenzene sulfonate, alkyl ether phosphoric acid, N-dodecylamine, dicocoamine, 1-aminoethyl-2-alkylimidazoline, 1-hydroxyethyl-2-alkylimidazoline, and cocoalkyl trimethyl quaternary ammonium chloride, and polyethylene tridecyl ether phosphate.

Illustrative fluorosurfactants include the following non-exhaustive listing:

$F(CF_2CF_2)_{1-7}$-alkyl-$N^+R_3Cl^-$ $C_8F_{17}SO_2NH\ C_3H_6N^+(CH_3)_3I^-$ $F(CF_2CF_2)_{1-7}CH_2CH_2S\ CH_2CH_2CO_2^-Li^+$ $C_8F_{17}SO_2N(C_2H_5)\ CH_2CO_2^-K^+$ $(F(CF_2CF_2)_{1-7}CH_2CH_2O)_{1,2}PO(O^-NH_4^+)_{1,2}$ $(F(CF_2CF_2)_{1-7}CH_2CH_2O)_{1,2}PO(O^-NH_4^+)_{1,2}$ $C_{10}F_{21}SO_3^-NH_4^+$ $C_6F_{13}CH_2CH_2SO_3H$, $C_6F_{13}CH_2CH_2SO_3^-NH_4^+$ $F(CF_2CF_2)_{1-7}CH_2CHOAcCH_2N^+R_2CH_2COO^-$ $R^{}SO_3^-$ $C_8F_{17}SO_2N\ (C_2H_5)\ (CH_2CH_2O)_xH$ $C_8F_{17}SO_2N\ (C_2H_5)\ (CH_2CH_2O)_xCH_3$ $F(CF_2CF_2)_{1-7}CH_2CH_2O(CH_2CH_2O)_yH$ and $F(CF_2CF_2)_{1-7}CH_2CH_2O(CH_2CH_2O)_zH$, where Rcontains an ammonium function, y<z, and y or z=0 to about 25.

Illustrative siliconated surfactants include the following non-exhaustive listing: polyether modified poly-dimethyl-siloxane, silicone glycol, polyether modified dimethyl-polysiloxane copolymer, and polyether-polyester modified hydroxy functional polydimethyl-siloxane.

The desorbable surfactant may be adsorbed onto the printing plate substrate by any conventional method, for example, by immersion in a solution of the surfactant or by spray, brush or curtain coater application of such a surfactant solution. The surfactant is preferably applied by immersion of the substrate in an aqueous solution of the surfactant for a time, typically one minute, which is effective to permit adsorption of the surfactant upon the substrate. The surfactant concentration may range from 0.001 to 1 percent, preferably 0.005 to 0.2 weight percent, of the solution. The aqueous solution may have a pH of from 4 to 8, and an ionic strength of from 0 to 0.25.

Non-adsorbed surfactant is then removed from the printing plate substrate surface. Preferably, the substrate is rinsed under tap water for approximately one minute to remove non-adsorbed surfactant. The rinsed plate is then dried, either at room temperature or in an oven. The resulting printing plate precursor has a desorbable surfactant on at least one surface, in an amount effective to improve the resolution of a subsequently applied ink receptive layer. This surfactant amount is typically at least 0.0005 gram/square meter of substrate, and preferably at least 0.001 grams/square meter of substrate.

A lithographic printing plate may be prepared from the printing plate precursor by image-wise applying an ink receptive composition to the substrate and then removing (desorbing) surfactant from any area of the substrate surface which does not form part of the desired image. Any ink receptive composition may be used with the printing plate substrate. Illustrative ink receptive compositions include solutions of resins in water and organic solvents and energy curable formulations. In one embodiment, the ink receptive composition is applied as a fluid composition by means of an ink jet printer, and then dried to form an ink receptive layer in the form of the desired image.

The desorbable surfactant increases the resolution of the printing plate substrate. Droplets of fluid composition applied by an ink jet printer onto the more hydrophobic substrate will not spread as much due to the reduced surface energy of the substrate precursor and the resulting lower interactions between the fluid composition droplet and the substrate precursor surface immediately below it. In short, the individual droplets of fluid composition will tend to stay where they have been individually deposited rather than spreading over the plate precursor. Reduced droplet spread results in increased resolution.

Without intending to be bound by theory, the inventors currently hypothesize that removal of non-adsorbed surfactant from the printing plate surface may produce a plate substrate having surfactant adsorbed at a plurality of discontinuous sites. The absence of a continuous, thick surfactant layer means that the subsequently applied ink receptive composition can be directly adhered to the printing plate precursor, thereby providing for strong adhesion of the ink receptive layer. FIG. 1 illustrates printing plate 10 having "islands" 20 and 30 of desorbable surfactant adsorbed onto the surface of the plate precursor. Fluid composition 40 contains ink receptive resin 50, which is adhered directly to the printing plate precursor surface between islands 20 and 30.

The desorbable surfactant must be removed from the non-imaged areas of the printing plate. Removal of the surfactant from the non-imaged areas restores the hydrophilic nature of the printing plate's non-image areas, thereby permitting lithographic printing of the image. Conventional fountain solutions will eventually desorb the surfactant during start-up of the printing press. However, it is preferred to desorb the surfactant by contacting the imaged plate with a conventional gumming solution.

Desorbing the surfactant from non-imaged areas of the printing plate does not remove surfactant from the imaged areas because the ink receptive material occludes the surfactant. Ink receptive materials which crosslink, by thermal or UV radiation, can provide even greater adhesion.

Figure 2:
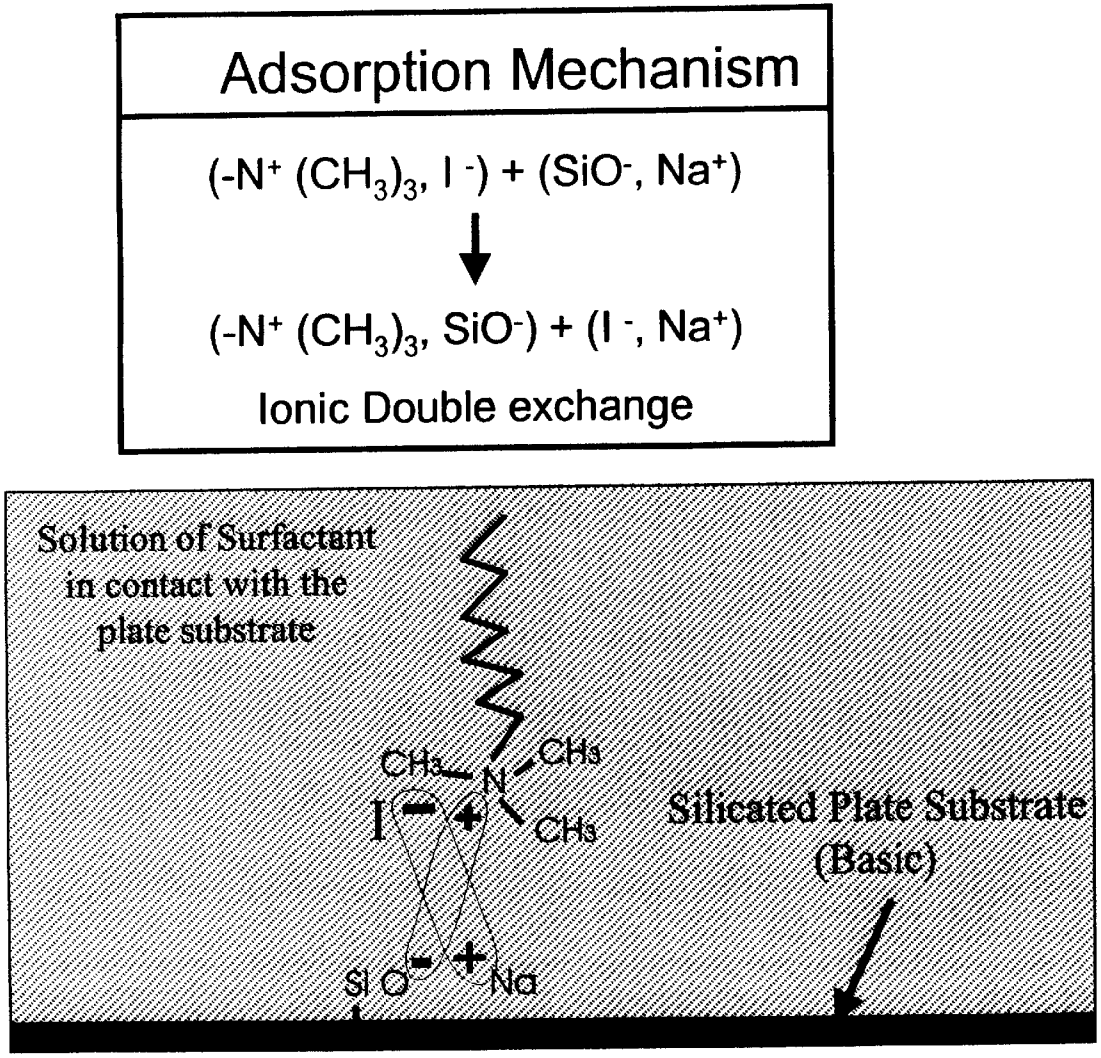
FIG. 2 illustrates theoretical mechanisms believed responsible for the improved properties exhibited by a lithographic printing plate produced by acid/base interfacial matching of a cationic desorbable surfactant to a basic surface of the printing plate substrate.

In an especially preferred embodiment, the desorbable surfactant is selected to "interfacially match" the printing plate substrate surface in order to promote adsorption. More particularly, it is preferred that a cationic desorbable surfactant be selected for use with a printing plate substrate having a mostly basic surface. Similarly, it is preferred that an anionic desorbable surfactant be selected for use with a printing plate substrate having a mostly acidic surface. Appropriate selection of the desorbable surfactant is believed to permit a double salt replacement to occur, as illustrated in FIG. 2 and explained below.

Without intending to be bound by theory, the inventors currently believe that an acid/base double salt substitution reaction occurs between the acid (i.e., positively charged) groups present in the cationic surfactant and the basic (i.e., negatively charged) sites present on the surface of the silicated lithographic plate. FIG. 2 illustrates this mechanism in the context of a silicated printing plate substrate 20 immersed in an aqueous solution of a cationic surfactant. The ammonium cation of the surfactant head is ionically bonded to the anionic silicate, while the surfactant's iodonium counterion forms a salt with the sodium counterion of the sodium silicate.

An analogous acid/base double salt substitution reaction is believed to occur between the basic groups of an anionic surfactant and a printing plate having acidic sites present on its surface.

EXAMPLES

The following examples illustrate preferred embodiments of the invention, and are not intended to limit the scope of the invention in any manner whatsoever.

Example 1

Preparation of a Partially Neutralized Cationic Copolymer

A mixture of methyl isobutyl ketone ("MIBK", 300 g), n-dodecylmercaptan (0.75 g) and VAZO 88 1,1'-azobicyclohexanecarbonitrile initiator (15 g) was stirred, nitrogen-blanketed and heated to reflux temperature. Then a blend of dimethylaminoethyl methacrylate (84 g), methyl methacrylate (216 g) and MIBK (20 g) was added dropwise over 2.5 hours at a constant rate. A solution of VAZO 88 initiator (1.5 g) in MIBK (20 g) was added thirty minutes later. Heating and stirring were discontinued about 4 hours later, resulting in a clear, golden solution. The solution was concentrated by removing about 166.2 g MIBK by distillation. At about 80° C., water (559 g) was added and azeotropic distillation began, and a pasty mass resulted. When the temperature of the pasty mass reached 90° C., water (55 g) and formic acid (19 g) were added, resulting in a much more fluid dispersion. Azeotropic distillation of this dispersion was continued until its temperature reached 99° C. and very little MIBK was being removed.

The product was an opaque dispersion of a 28% DMAEMA/72% MMA copolymer 75% neutralized with formic acid. The dispersion had a pH of 6.20, a percent solids of 33.2, and a Brookfield viscosity of 16900 centipoise at 5 rpm.

Example 2

Preparation of a Partially Neutralized Anionic Copolymer

A styrene-acrylic copolymer having a weight average molecular weight of 8,500, an acid number of 215 and a Tg of 85° C. (JONCRYL 678, commercially available from S C Johnson, Racine, Wis.) was dissolved in water by partial neutralization (85 to 90%) with ammonia.

Example 3

Formulation of Fluid Compositions

Fluid compositions were prepared by adding an appropriate amount of the partially neutralized copolymer dispersions of Examples 1 and 2 to deionized water which additionally contained a non-ionic surfactant and a glycerol humectant. The mixture was stirred to ensure homogeneous mixing, and filtered through a 1 micron pore size filter. The resulting fluid compositions are set forth below in Table 1 below:

TABLE 1

| Formulation | Polymer | Non-ionic Surfactant | Deionized Water | Humectant |
|---|---|---|---|---|
| III-1 | 3% Ex. 1 | 0.3% SURFYNOL 465[1] | 94.7% | 2% glycerol |
| III-2 | 3% Ex. 2 | 0.55% SURFYNOL 465 | 94.45% | 2% glycerol |

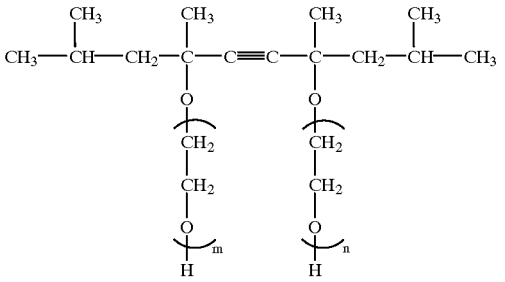

(m + n = 10)

Example 4

Preparation of Printing Plate Substrates

The printing plate substrates were each based on aluminum oxide and were subjected to various conventional surface treatments well known to those skilled in the art. These treatments result in different roughnesses, topologies and surface chemistries. Table 2 lists the substrates employed in the ink drop test:

TABLE 2

Substrate Samples Employed For the Ink Drop Test

| Substrate Refs. | Surface Treatment | Interlayer Treatment | Surface Property |
|---|---|---|---|
| AA | Quartz grained and Anodized | None | Acidic |
| EG-PVPA | Electrograined and Anodized | Polyvinyl phosphonic acid | Acidic |
| EG-Sil | Electrograined and Anodized | Sodium Silicate | Basic |
| G20 | Electrograined and Anodized | Vinylphosphonic acid/acrylamide copolymer | Acidic |
| DS-Sil | Chemically Grained and Anodized | Sodium Silicate | Basic |
| PG-Sil | Pumice grained and Anodized | Sodium Silicate | Basic |
| CHB-Sil | Chemically Grained, Anodized and Silicated | Sodium Silicate | Basic |

Notes:
"AA" means "as anodized". The aluminum surface is first quartz grained and then anodized using DC current of about 8 A/cm$^2$ for 30 seconds in a $H_2SO_4$ solution (280 g/liter) at 30° C.
"EG" means "electrolytic graining". The aluminum surface is first degreased, etched and subjected to a desmut step (removal of reaction products of aluminum and the etchant). The plate is then electrolytically grained using an AC current of 30–60 A/cm$^2$ in a hydrochloric acid solution (10 g/liter) for 30 seconds at 25° C., followed by a post-etching alkaline wash and a desmut step. The grained plate is then anodized using DC current of about 8 A/cm$^2$ for 30 seconds in a $H_2SO_4$ solution (280 g/liter) at 30° C.
"PVPA" is polyvinylphosphonic acid. The plate is immersed in a PVPA solution and then washed with deionized water and dried at room temperature.
"DS" means "double sided smooth". The aluminum oxide plate is first degreased, etched or chemically grained, and subjected to a desmut step. The smooth plate is then anodized.
"Sil" means the anodized plate is immersed in a sodium silicate solution. The coated plate is then rinsed with deionized water and dried at room temperature.
"PG" means "pumice grained". The aluminum surface is first degreased, etched and subjected to a desmut step. The plate is then mechanically grained by subjecting it to a 30% pumice slurry at 30° C., followed by a post-etching step and a desmut step. The grained plate is then anodized using DC current of about 8 A/cm$^2$ for 30 seconds in an $H_2SO_4$ solution (280 g/liter) at 30° C. The anodized plate is then coated with an interlayer.
"G20" is a printing plate substrate which is described in U.S. Pat. No. 5,368,974, the disclosure of which is incorporated herein by reference in its entirety.
"CHB" means chemical graining in a basic solution. After an aluminum substrate is subjected to a matte finishing process, a solution of 50 to 100 g/liter NaOH is used during graining at 50 to 70° C. for 1 minute. The grained plate is then anodized using DC current of about 8 A/cm$^2$ for 30 seconds in an $H_2SO_4$ solution (280 g/liter) at 30° C. The anodized plate is then coated with a silicated interlayer.

Those of ordinary skill in the art will understand that the "basic" and "acidic" descriptions of the surface chemistry of the printing plate substrates summarized above are relative terms. Thus, a "basic" surface will have a plurality of basic sites and acidic sites present, with the basic sites predominating to some degree. Similarly, an "acidic" surface will have a plurality of acidic sites and basic sites present, with the acidic sites predominating to some degree. The PG-silicated printing plate substrate appears to have a higher silicate site density that the double sided printing plate substrate, and is more basic. The G20 printing plate substrate exhibits less acidic behavior than anodized only ("AA") printing plate substrates.

Example 5

Fluorosurfactant Pretreatment

The printing plate substrates of Example 4 were each immersed in a fluorosurfactant solution (0.1% in deionized water) for one minute, rinsed under tap water for one minute and then dried at room temperature. Table 3 lists the commercially available fluorosurfactants employed to pretreat the printing plate substrates prior to evaluation of ink dot spread:

TABLE 3

Fluorosurfactants

| Trade Name | Chemical Structure | Type |
|---|---|---|
| Zonyl FSD | $F(CF_2CF_2)_{1-7}$-alkyl-$N^+R_3Cl^-$ | Cationic |
| Fluorad FC-135 | $C_8F_{17}SO_2NHC_3H_6N^+(CH_3)_3I^-$ | Cationic |
| Zonyl FSA | $F(CF_2CF_2)_{1-7}CH_2CH_2SCH_2CH_2CO_2^-Li^+$ | Anionic |
| Fluorad FC-129 | $C_8F_{17}SO_2N(C_2H_5)CH_2CO_2^-K^+$ | Anionic |
| Zonyl FSP | $(F(CF_2CF_2)_{1-7}CH_2CH_2O)_{1,2}PO(O^-NH_4^+)_{1,2}$ | Anionic |
| Zonyl FSJ* | $(F(CF_2CF_2)_{1-7}CH_2CH_2O)_{1,2}PO(O^-NH_4^+)_{1,2}$ | Anionic |
| Fluorad FC-120 | $C_{10}F_{21}SO_3^-NH_4^+$ | Anionic |
| Zonyl FS-62 | $C_6F_{13}CH_2CH_2SO_3H$, $C_6F_{13}CH_2CH_2SO_3^-NH_4^+$ | Anionic |
| Zonyl FSK | $F(CF_2CF_2)_{1-7}CH_2CHOAcCH_2N^+R_2CH_2COO^-$ | Amphoteric |
| Fluorad FC-100 | $R^{**}SO_3^-$ photeric | Am- |
| Fluorad FC-170C | $C_8F_{17}SO_2N(C_2H_5)\ (CH_2CH_2O)_xH$ | Nonionic |
| Fluorad FC-171 | $C_8F_{17}SO_2N(C_2H_5)\ (CH_2CH_2O)_xCH_3$ | Nonionic |
| Zonyl FSO*** | $F(CF_2CF_2)_{1-7}CH_2CH_2O(CH_2CH_2O)_yH$ | Nonionic |
| Zonyl FS-300*** | $F(CF_2CF_2)_{1-7}CH_2CH_2O(CH_2CH_2O)_zH$ (z > y) | Nonionic |

*FSJ also contains a nonfluorinated surfactant.
**R contains an ammonium function.
***y or z = 0 to about 25.

Zonyl surfactants are commercially available from E. I. du Pont de Nemours & Co. and have a wide distribution of perfluoroalkyl chain length: $R_f$ is $(CF_2CF_2)_{1-7}$, with an average of 3.5. Fluorad surfactants are commercially available from 3M Company and have a narrow distribution of the hydrophobic chain length.

Example 6

Siliconated Surfactant Pretreatment

Several of the printing plate substrates of Example 4 were immersed in a siliconated surfactant solution (1% of BYK-348, a polyether modified poly-dimethyl-siloxane, in deionized water) for one minute, rinsed under tape water for one minute and then dried at room temperature.

Example 7

Evaluation of Ink Dot Spread

The fluid compositions prepared in Example 3 above were evaluated for ink dot spread after application to the printing plate precursors of Examples 5 and 6 according to the following procedure:

A 10 $\mu$l chromatographic microsyringe with a flat needle was filled with the fluid composition to be studied. A droplet was formed at the needle extremity and dropped on the printing plate precursor surface from a height of about 3 mm. The volume of the droplet is about 5 $\mu$l±6% for both fluid compositions. After deposition of 4 or 5 droplets, the plate was dried in an oven at 120° C., and the resulting dot diameters were measured manually and averaged. In the case of ovoid spreading, the smaller dot diameter was recorded. In the case of heterogeneous spreading, either no value was recorded or a best estimate was used.

TABLE 4

Dot Diameter of Fluid Composition III-1 Upon Surfactant-Pretreated Printing Plate Substrates

| | | Dot diameter (mm) determined by Drop Test | | | |
|---|---|---|---|---|---|
| | | "Basic" Plate Substrate | | "Acidic" Plate Substrate | |
| | Pretreatment | PG-Silicate | DS-Silicate | G20 | AA |
| | Not Pretreated | 4.5 | 5 | 8 | 6 |
| Cationic | FC-135 | 3 | 3.5 | 8.5 | 5.5 |
| | FSD | 3 | 4 | | |
| Anionic | FC-129 | 3.5 | 6 | 7.5 | 2.75 |
| | FSA | 3.75 | 4.5 | | 2–3 |
| | FSJ | | | 3.5 | 2 |
| | FSP | | | | 2.5 |
| | FS-62 | | | | 5 |
| | FC-120 | 7 | | | 5.5 |
| Nonionic | FC-170C | 4.5 | 5 | | |
| | FC-171 | 4.5 | 5 | | 5.5 |
| | FSO | 6 | 5.25 | 7 | 4.5 |
| | FS-300 | 5 | 5.5 | | |
| Amphoteric | FSK | 3 | 5 | | |
| | FC-100 | 4 | 4.5 | | |
| Siliconated | BYK-348 | 4 | | 6.5 | 4.5 |

TABLE 5

Dot Diameter of Fluid Composition III-2 Upon Surfactant Pretreated Printing Plate Substrates

| | | Dot diameter (mm) determined by Drop Test | | | |
|---|---|---|---|---|---|
| | | "Basic" Plate Substrate | | "Acidic" Plate Substrate | |
| | Pretreatment | PG-Silicate | DS-Silicate | G20 | AA |
| | Not Pretreated | 8 | 7 | 7.5 | 5.75 |
| Cationic | FC-135 | 4 | 4.75 | 7.5 | 4.5 |
| | FSD | 4 | 5 | | 5 |
| Anionic | FC-129 | 5.5 | 7 | | 2.75 |
| | FSA | 4.25 | 5.25 | | 2–3 |
| | FSJ | | | 3.4 | 1.5 |
| | FSP | | | | 2 |
| | FS-62 | | | | 4 |
| | FC-120 | | | | 5.5 |
| Nonionic | FC-170C | 4.75 | 5.5 | | |
| | FC-171 | 6 | 5 | | 7 to 10 |
| | FSO | 8 | 5.25 | 7 | 4 |
| | FS-300 | 6.5 | 6 | | |
| Amphoteric | FSK | 4.75 | 6 | | |
| | FC-100 | 4.75 | 5.75 | | |

Example 8

Formulation of A Solvent-based Thermally Curable Epoxy Fluid Composition

A cycloaliphatic epoxy monomer (3,4-epoxy cyclohexyl methyl-3,4-epoxy cyclohexyl carboxylate, commercially available from Union Carbide under the trademark CYRACURE 6105), was mixed with diethylene glycol di-methyl ether, methyl carbitol and an experimental, thermally activated curing agent (blocked acid sulfonium salt, under the name NACURE TLC 14-12 from King Industries). The resulting thermally curable epoxy fluid composition is set forth in Table 6 below:

TABLE 6

| Component | Weight Percent |
|---|---|
| CYRACURE 6105 Epoxy Monomer | 19.5 |
| Di-ethylene glycol dimethyl ether | 46.8 |
| Methyl carbitol | 31.2 |
| King TLC-1412 Curing Agent | 2.5 |

Example 9

Formulation of A UV Curable Epoxy Fluid Composition

Two UV curable epoxy fluid compositions were prepared. In both cases CYRACURE 6105 epoxy monomer was mixed with limonene dioxide (dipentene dioxide, commercially available from Elf Atochem North America, Inc., Two Appletree Square, Bloomington, Minn. 55425) and triaryl sulfonium hexafluoroantimonate (a UV photoinitiator commercially available from Union Carbide Corporation under the trademark UVI 6974). Pigment black 7 (carbon black) was also added to one of the two compositions. The CYRACURE 6105 and the Pigment Black 7 were mixed together in a 3:1 ratio. After processing the remaining components were added slowly at a low mixing speed. The resulting UV curable epoxy fluid compositions are set forth in Table 7 below:

TABLE 7

| Component | IX-1 | IX-2 |
|---|---|---|
| CYRACURE 6105 Epoxy Monomer | 15 | 23.8 |
| Limonene Dioxide | 75 | 71.4 |
| UVI 6974 Initiator | 5 | 4.8 |
| Pigment Black 7 | 5 | — |

Example 10

Press Trial Evaluation

Various fluorosurfactant-pretreated and non-pretreated printing plate substrates were imaged with various fluid compositions using a piezoelectric drop-on-demand ink jet printer. The plates imaged with fluid composition VIII were dried and the image areas were thermally cured in an oven at 160° C. for 20 s. The plates imaged with fluid composition IX-1 and IX-2 were subjected to UV radiation and the image areas were cured at 200 fpm, with 2 lamps having an output of 300 Watts/inch in the UV spectral region and a cylindrical reflector. Surfactant adsorbed on non-imaged areas of the imaged printing plates was removed by subjecting them to a conventional gumming step. The dot diameters and spreading ratios of the fluid compositions deposited onto the printing plate substrates was measured. Several of the gummed plates were then mounted on a lithographic printing press and used to print a number of copies. The results are summarized in Table 8 below:

TABLE 8

Effect of Different Fluorosurfactant Pre-treatment on Printing Plate Substrates

| Printing Plate Substrates | Fluorosurfactant Treatment | Fluid Composition | Press Run Length | Dot diam. (μm) | Spreading Ratio |
|---|---|---|---|---|---|
| CHB-Sil | None (Control) | III-1 | >40,000 | 63.6 | 2.13 |
| CHB-Sil | FC-135 (Cationic) | III-1 | >40,000 | 44.7 | 1.49 |
| PG-Sil | None (Control) | III-1 | >40,000 | 68.6 | 2.29 |
| PG-Sil | FC-135 (Cationic) | III-1 | >40,000 | 34.1 | 1.14 |
| DS-Sil | None (Control) | III-1 | >40,000 | 60.3 | 2.02 |
| DS-Sil | FC-135 (Cationic) | III-1 | >40,000 | 34.0 | 1.14 |
| EG-Silicate | None (Control) | III-1 | >60,000 | 44.9 | 1.99 |
| EG-Silicate | FC-135 (Cationic) | III-1 | >60,000 | 25.6 | 1.16 |
| EG-Silicate | FC-129 (Anionic) | III-1 | 60,000 | 32.5 | 1.44 |
| As Anodized | None (Control) | III-1 | 1,500 | 42.4 | 1.88 |
| As Anodized | FC-135 (Cationic) | III-1 | 6,000 | 36.8 | 1.63 |
| As Anodized | FC-129 (Anionic) | III-1 | 30,000 | 21.7 | 0.96 |
| G20 | None (Control) | III-1 | Not Done | 107.5 | 4.77 |
| G20 | FSJ (Anionic) | III-1 | Not Done | 31.1 | 1.38 |
| G20 | FSK (Anionic) | III-1 | Not Done | 34.2 | 1.52 |
| CHB-Sil | None (Control) | VIII | Not Done | 210.0 | 7.02 |
| CHB-Sil | FC-135 (Cationic) | VIII | >100,000 | 46.4 | 1.55 |
| CHB-Sil | FC-120 (Anionic) | VIII | Not Done | 165 | 5.52 |
| DS-Sil | None (Control) | VIII | Not Done | 205 | 6.86 |
| DS-Sil | FC-135 (Cationic) | VIII | >100,000 | 48.2 | 1.61 |
| CHB-Sil | None (Control) | IX-1 | Not Done | 320.3 | 6.12 |
| CHB-Sil | FC-135 (Cationic) | IX-1 | Not Done | 103.9 | 1.99 |
| DS-Sil | None (Control) | IX-1 | Not Done | 335.6 | 6.41 |
| DS-Sil | FC-135 (Cationic) | IX-1 | Not Done | 100.6 | 1.92 |
| EG-Sil | None (Control) | IX-1 | Not Done | 326.8 | 6.25 |
| EG-Sil | FC-135 (Cationic) | IX-1 | Not Done | 108.1 | 2.07 |
| DS-Sil | None (Control) | IX-2 | Not Done | 285.2 | 5.45 |
| DS-Sil | FC-135 (Cationic) | IX-2 | Not Done | 80 | 1.53 |

Notes:
"Dot diameter" is an average value of the size of the dot formed on the substrate by the ink jet applied, dried droplet based on over 30 dots, and was determined by optical microscopy and commercially available Image Pro computer software.
"Spreading Ratio" is an average ratio of dot diameter:droplet diameter, where droplet diameter is defined as the size of a droplet formed by the ink jet printer employed to apply the fluid composition to the substrate as defined by the printer manufacturer.
The press run lengths of the samples were limited by the limited amount of press time available. Thus, the various press lengths reported above should not be considered as a reflection on the resistance of the individual printing plates evaluated. The symbol for greater than (">") indicates that the press trial was stopped before any damage to the plate image areas occurred.

Example 11

Formulation of a Thermally Curable Epoxy-Based Fluid Composition

CYRACURE 6105 epoxy monomer (3,4-epoxy cyclohexyl methyl-3,4-epoxy cyclohexyl carboxylate) was mixed with limonene dioxide and NACURE TLC 14-12 thermally activated curing agent. The resulting fluid composition is set forth in Table 9 below:

TABLE 9

| Component | Weight Percent |
|---|---|
| Epoxy diluent | 10.8 |
| Limonene Dioxide | 86.5 |
| King TLC-1412 Curing Agent | 2.7 |

Example 12

Non-Fluorinated Surfactant Pretreatment

A variety of the printing plate substrates of Example 4, Table 2, were each immersed in a 0.3% non-fluorosurfactant aqueous solution, rinsed with tap water for one minute and then dried in an oven (120° C. for one minute) to produce printing plate precursors. Control substrates were rinsed with water and dried in an oven (120° C. for one minute). The surfactant-pretreated printing plate substrates and the controls were then evaluated for ink drop spread using the procedures of Example 4 and the epoxy-based fluid composition of Example 11.

The test results indicate that the surfactant adsorbed on the plate substrate, and can be utilized to control spreading of the fluid composition. Moreover, spreading was even more limited on the "basic" plate with the "cationic" surfactant, and on the "acidic" plate with the "anionic" surfactant.

TABLE 10

Dot Diameter of Cationic Epoxy-Based Fluid Composition IX-1 Upon Surfactant-Pretreated Printing Plate Substrates

| | | Dot diameter (mm) determined by Drop Test | |
|---|---|---|---|
| | Pretreatment | EG-Silicate "Basic" Plate | EG-PVPA "Acidic" Plate |
| | Not Pretreated | 21 | 25 |
| Cationic | Adogen 461 | 7 | 8 |
| Anionic | SDS | 12 | 4 |

TABLE 10-continued

Dot Diameter of Cationic Epoxy-Based Fluid Composition IX-1 Upon Surfactant-Pretreated Printing Plate Substrates

| Pretreatment | Dot diameter (mm) determined by Drop Test | |
|---|---|---|
| | EG-Silicate "Basic" Plate | EG-PVPA "Acidic" Plate |

Notes:
"SDS" is sodium dodecylsulfate, commercially available from Aldrich Chemical Co., Inc., P.O. Box 355, Milwaukee, Wisconsin 53201.
"ADOGEN 461" is cocoalkyl trimethyl quaternary ammonium chloride, commercially available from Witco Chemical Corporation, P.O. Box 45296, Houston, Texas 77245.

Example 13

Comparison of Non-Fluorinated Surfactants to Fluorosurfactants For Printing Plate Substrate Pretreatments Two fluorosurfactants and two non-fluorinated surfactants were used to pretreat printing plate substrates using the procedures of the previous Examples. A solvent-based epoxy fluid composition was used to evaluate the drop spreading exhibited by the precursors.

TABLE 11

Dot Diameter of Fluorosurfactant vs. Non-Fluorinated Surfactant-Pretreated Printing Plate Substrates

| | Pretreatment | Dot diameter (mm) determined by Drop Test CHB-Sil "Basic" Plate |
|---|---|---|
| | Not Pretreated | 26 |
| Cationic | FC-135 | 4 |
| | ADOGEN 461 | 9 |
| Anionic | SDS | 11 |
| | FC-120 | 11 |

We claim:

1. A printing plate precursor for direct receipt of an image-wise applied ink receptive layer, comprising a desorbable surfactant adsorbed on at least one surface of a printing plate substrate, wherein the desorbable surfactant is present in an amount effective to improve the resolution of the subsequently image-wise applied ink receptive layer, and the desorbable surfactant is discontinuously adsorbed on said printing plate substrate.

2. The printing plate precursor of claim 1, wherein said substrate is selected from the group consisting of aluminum, polymeric film and paper.

3. The printing plate precursor of claim 2, wherein said substrate is roughened aluminum.

4. The printing plate precursor of claim 1, wherein said surface also carries a plurality of basic sites.

5. The printing plate precursor of claim 4, wherein said basic sites comprise silicate groups.

6. The printing plate precursor of claim 1, wherein said surface also contains a plurality of acidic sites.

7. The printing plate precursor of claim 6, wherein said acidic sites comprise at least one member selected from the group consisting of sulfuric acid groups, phosphonic acid groups and carboxylic acid groups.

8. The printing plate precursor of claim 1, wherein said surface is amphoteric.

9. The printing plate precursor of claim 1, wherein said desorbable surfactant is selected from the group consisting of alkyl tail surfactants, fluorosurfactants and siliconated surfactants.

10. The printing plate precursor of claim 9, wherein said desorbable surfactant is an alkyl tail surfactant selected from the group consisting of sodium dodecylsulfate, an isopropylamine salt of an alkylarylsulfonate, sodium dioctyl succinate, sodium methyl cocoyl taurate, dodecylbenzene sulfonate, an alkyl ether phosphoric acid, N-dodecylamine, dicocoamine, 1-aminoethyl-2-alkylimidazoline, 1-hydroxyethyl-2-alkylimidazoline, and cocoalkyl trimethyl quaternary ammonium chloride.

11. The printing plate precursor of claim 9, wherein said desorbable surfactant is a fluorosurfactant selected from the group consisting of $F(CF_2CF_2)_{1\text{-}7}$-alkyl-$N^+R_3Cl^-$ $C_8F_{17}SO_2NH\ C_3H_6N^{30}\ (CH_3)_3I^-$ $F(CF_2CF_2)_{1\text{-}7}CH_2CH_2S\ CH_2CH_2CO_2^-Li^+$ $C_8F_{17}SO_2N(C_2H_5)CH_2CO_2^-K^+$ $(F(CF_2CF_2)_{1\text{-}7}CH_2CH_2O)_{1,2}PO(O^-NH_4^+)_{1,2}$ $(F(CF_2CF_2)_{1\text{-}7}CH_2CH_2O)_{1,2}PO(O^-NH_4^+)_{1,2}$ $C_{10}F_{21}SO_3^-NH_4^+$ $C_6F_{13}CH_2CH_2SO_3H$, $C_6F_{13}CH_2CH_2SO_3^-NH_4^+$ $F(CF_2CF_2)_{1\text{-}7}CH_2CHOAcCH_2N^+R_2CH_2COO^-$ $C_8F_{17}SO_2N(C_2H_5)\ (CH_2CH_2O)_xH$ $C_8F_{17}SO_2N(C_2H_5)\ (CH_2CH_2O)_xCH_3$ $F(CF_2CF_2)_{1\text{-}7}CH_2CH_2O(CH_2CH_2O)_yH$ and $F(CF_2CF_2)_{1\text{-}7}CH_2CH_2O(CH_2CH_2O)_zH$, wherein y is less than z, with the proviso that y or z is 0 to 25.

12. The printing plate precursor of claim 9, wherein said desorbable surfactant is a siliconated surfactant selected from the group consisting of polyether modified polydimethyl-siloxane, silicone glycol, polyether modified dimethyl-polysiloxane copolymer, and polyether-polyester modified hydroxy functional polydimethyl-siloxane.

13. A printing plate precursor prepared by a method comprising:

(a) applying a desorbable surfactant to at least one surface of a printing plate substrate; and (b) removing non-adsorbed surfactant from said surface such that the surfactant is discontinuously adsorbed on the substrate.

14. A printing plate prepared by a method comprising:

(a) applying a desorbable surfactant to at least one surface of a printing plate substrate;

(b) removing non-adsorbed surfactant from said surface such that the surfactant is discontinuously adsorbed on the substrate;

(c) applying a fluid composition containing an ink receptive material onto at least a portion of said surface in the form of a desired image, thereby providing an ink receptive image layer; and (d) removing said desorbable surfactant from any area of the surface which does not form part of the desired image.

15. The printing plate of claim 14, wherein said ink receptive material is a member of the group consisting of water-dispersible catonic resins, or water-dispersible anionic resins.

16. The printing plate of claim 14, wherein said ink receptive material is cross linkable.

17. A method for preparing a printing plate precursor, comprising:

(a) applying a desorbable surfactant to at least one surface of a printing plate substrate; and (b) removing non-adsorbed surfactant from said surface such that the surfactant is discontinuously adsorbed on the substrate.

18. A method for preparing a printing plate comprising:

(a) applying a desorbable surfactant to at least one surface of a printing plate substrate;

(b) removing non-adsorbed surfactant from said surface such that the surfactant is discontinuously adsorbed on the substrate;

(c) applying a fluid composition containing an ink receptive material onto at least a portion of said surface in the form of a desired image, thereby providing an ink-receptive image layer; and (d) removing said desorbable surfactant from any area of the surface which does not form part of the desired image.

19. The method of claim 18, wherein said desorbable surfactant is selected from the group consisting of alkyl tail surfactants, fluorosurfactants and siliconated surfactants.

20. The method of claim 18, wherein said desorbable surfactant is adsorbed onto said surface by contacting said substrate with a solution of said surfactant.

21. The method of claim 20, wherein said desorbable solution has a surfactant concentration of from 0.001 to 1 percent by weight of the solution.

22. The method of claim 21, wherein said desorbable surfactant concentration is from 0.005 to 0.2 weight percent of the solution.

23. The method of claim 20, wherein said solution is aqueous and has a pH of from 4 to 8.

24. The method of claim 23, wherein said aqueous solution has an ionic strength of from 0 to 0.25.

25. The method of claim 18, wherein said ink receptive material is a member of the group consisting of water-dispersible cationic resins, or water-dispersible anionic resins.

26. The method of claim 18, wherein said ink receptive material is crosslinkable.

27. The method of claim 26, wherein said crosslinkable material is an epoxy compound.

28. The method of claim 26, wherein said ink receptive material is crosslinkable by ultraviolet irradiation.

29. The method of claim 26, wherein said ink receptive material is crosslinkable by infrared irradiation.

30. The method of claim 18, wherein said desorbable surfactant is removed by contacting said printing plate substrate with a fountain solution.

31. The method of claim 18, wherein said desorbable surfactant is removed by contacting said printing plate substrate with a gumming solution.

32. The method of claim 18, wherein said ink receptive image layer is applied by ink jet printing so as to produce a plurality of dots on said surface, said dots having a spreading ratio of not more than 2.5.

33. The method of claim 32, wherein said dots have a spreading ratio of not more than 2.2.

* * * * *

UNITED STATES PATENT AND TRADEMARK OFFICE

CERTIFICATE OF CORRECTION

PATENT NO. : 6,276,273 B1
DATED : August 21, 2001
INVENTOR(S) : Aurenty et al.

It is certified that error appears in the above-identified patent and that said Letters Patent is hereby corrected as shown below:

Title page,
Item [56], References Cited, OTHER PUBLICATIONS: "Dupont"
should read -- DuPont --

Column 6,
Table 1: The following footnote should be added at the end of Table 3: -- [1]Non-ionic surfactant conforming to the following formula and commercially available from Air Products Co. under the SURFYNOL 465 trademark: --

Column 8,
Table 3: "photeric" (second occurrence) should be moved to column 3 in the Table.
Line 52, "tape" should read -- tap --

Column 10,
Line 64, "was" should read -- were --

Column 14,
Line 13, "$C_3H_6N^{30}$" should read -- $C_3H_6N^+$ --
Line 57, "catonic" should read -- cationic --

Signed and Sealed this

Second Day of July, 2002

*Attest:*

*Attesting Officer*

JAMES E. ROGAN
*Director of the United States Patent and Trademark Office*